United States Patent [19]

Cook

[11] 4,196,675

[45] Apr. 8, 1980

[54] FOLDING DRAFTING TABLE

[76] Inventor: John L. Cook, 4544 Hickory Village, Apt. 3C, Mishawaka, Ind. 46544

[21] Appl. No.: 910,074

[22] Filed: May 26, 1978

[51] Int. Cl.[2] ..... A47F 5/12

[52] U.S. Cl. ..... 108/6; 108/124

[58] Field of Search ..... 108/115, 124, 1-10, 108/116, 117, 127

[56] References Cited

U.S. PATENT DOCUMENTS

| | | | |
|---|---|---|---|
| 456,990 | 8/1891 | Hawley | 108/10 |
| 1,898,666 | 2/1933 | Isaacson | 108/6 |
| 2,860,020 | 11/1958 | Nickliss et al. | 108/124 |
| 2,887,348 | 5/1959 | Sadowsky | 108/124 |
| 3,059,274 | 10/1962 | Fassero et al. | 108/6 X |
| 3,140,559 | 7/1964 | Grow et al. | 108/6 |
| 3,217,673 | 11/1965 | Knoblock | 108/157 |
| 3,640,228 | 2/1972 | Busse | 108/6 |
| 3,805,710 | 4/1974 | Leshem | 108/6 |
| 4,099,469 | 7/1978 | Sahli | 108/115 |

FOREIGN PATENT DOCUMENTS

| | | | |
|---|---|---|---|
| 801010 | 11/1950 | Fed. Rep. of Germany | 108/124 |

*Primary Examiner*—Ramon S. Britts
*Assistant Examiner*—Peter A. Aschenbrenner
*Attorney, Agent, or Firm*—Frost & Jacobs

[57] ABSTRACT

A folding drafting table having means for adjusting the height and means independent of height adjusting means to secure the table top at a desired angle. In a folding position the table top is substantially parallel to a main frame having a pair of spaced leg portions folded inwardly, the table being relatively compact in the folding position.

3 Claims, 9 Drawing Figures

FOLDING DRAFTING TABLE

BACKGROUND OF THE INVENTION (1) Field of the Invention

This invention relates to a folding drafting table and the like having means for adjusting the height and means independent of height adjusting means to secure the table-top at a desired angle. In folded position the table-top is substantially parallel to a main frame having a pair of spaced leg portions folded inwardly, the table being relatively compact in the folded position.

(2) Description of the Prior Art

Numerous patents relate to drafting tables, foldable or otherwise, to means for selecting a desired height or angle for the table-top and to foldable tables.

U.S. Pat. No. 3,217,673, issued Nov. 16, 1965 to F. D. Knoblock, discloses a folding typewriter table comprising a U-shaped single piece main frame having two vertical leg portions and a connecting cross-portion at the top, a pair of U-shaped side members, each comprising a lower arm for resting horizontally on a floor and an upper arm substantially parallel thereto for supporting the underside of a table-top, the side members being pivotally connected to vertical portions of the leg portions of the main frame, so that one side member may be pivoted flat against the main frame and the other side member may be folded flat against the one folded side member, a brace extending between the legs of the main frame and a brace extending between the upper and lower arms of each side member, and means for releasably securing said braces in position. The table of this patent provides no means for adjustment of the height thereof, and no means for adjusting the angle of the table-top since it is intended for use only as a typewriter table.

U.S. Pat. No. 3,805,710, issued Apr. 23, 1974 to A. Leshem, discloses a foldable table having a table-top which can be adjustably secured at a selected attitude or tilt. A frame is provided having a pair of spaced parallel leg portions in a common plane, with a side leg supported on each leg portion of the frame for swinging movement between a folded position wherein the side legs are overlapped and generally parallel to the frame and an operative position wherein the legs are perpendicular to the frame. The pivot axis of the side legs are "located in differentially offset relation to the common plane containing the leg portions of the frame." A table-top supporting extension is mounted on each leg portion of the frame for movement between a retracted position and selected elevated positions, with a table-top supported on the extensions for swinging movement between an operative position and a folded position, the table-top in its folded position being parallel to the frame with the side legs interposed and retained between the table-top and the frame. Each leg portion of the frame, and each side leg have extensible supports mounted in coaxial telescoping relation to the legs, and manually operable locks for each leg portion and side leg.

The structural arrangement is therefore such that adjustment of the height of the table-top can be effected only by individual adjustment of four extensible supports and the manually operable lock for each, and adjustment of a desired attitude or tilt of the table-top can be effected only after the height has been adjusted, by further movement of the extensible supports of the leg portions of the frame and the locks for each . It is thus apparent that the means for adjustment are inconvenient and subject to error since there is no correlation among the various extensible supports. Moreover, the overlapped relation of the side legs when in folded position does not provide the most compact package possible.

Other U.S. Patents relating to tables with tiltable surfaces, folding tables, and vertical adjustability of folding tables, include the following:

| | |
|---|---|
| 3,908,560 | 2,879,118 |
| 3,589,311 | 3,365,072 |
| 3,525,492 | 3,000,683 |
| 3,145,966 | 2,733,971 |
| 3,080,193 | 2,106,309 |
| 2,837,394 | 3,256,840 |
| 3,786,766 | 986,131 |
| 3,247,811 | 981,114 |

It is evident that a genuine need exists for a folding drafting table and the like which provides easy and convenient adjustability of the height of the table-top and easy and convenient adjustability of the tilt or angle of the table-top about a horizontal axis independent of the height adjustment, and which is at the same time capable of being folded into an extremely compact package. To the best of applicant's knowledge such a structure has not previously been disclosed or suggested.

SUMMARY OF THE INVENTION

It is a principal object of the present invention to provide a folding drafting table and the like having the above combination of desirable features.

It is a further object of the invention to provide a foldable drafting table which is readily collapsible without requiring removal of nuts, bolts, knobs and the like.

It is still another object of the invention to provide a folding drafting table permitting great versatility in selection of the angle of adjustment of the table-top irrespective of the height thereof above the floor.

The above objectives are achieved, in accordance with the present invention, in a folding drafting table comprising a U-shaped main frame having a pair of spaced, generally vertical leg portions, a pair of side members each having a lower arm portion adapted to rest horizontally on a floor substantially normal to the plane of the main frame and a substantially vertical upper arm portion, means for pivotally connecting the upper arm portion of each side member to a respective one of the vertical leg portions whereby the side members may be folded inwardly flat against the main frame in a common plane, a table-top support member extending substantially horizontally above the top of the leg portions, means for pivotally connecting the table-top support member to each of the leg portions, means for adjusting the length of each of the leg portions, the adjusting means biasing the table-top support member upwardly, means for securing the table-top support member in a desired position of pivotal adjustment independent of the means for adjusting the length of each leg portion, and a table-top secured in overlying relation to the table-top support member for swinging movement between horizontal and folded positions, the table-top in folded position being substantially parallel to the main frame with the side members interposed therebetween.

The above described structure permits adjustment of the angle or tilt of the table-top at any desired angle between horizontal and about 70° below horizontal without adjustment of the length of the leg portions.

Preferably, a brace is provided which extends between the lower arm portions when the table is erected in operative position, with means for releasably engaging each end of the brace with one of the lower arm portions. When it is desired to fold the table into collapsed position, the brace is first removed, and clip means are provided attached to the underside of the table-top for releasably stowing the brace. The clip means are so located as to permit stowing of the brace with clearance between the inwardly folded side members and the table-top support member.

The table-top support member comprises an elongated substantially horizontal tubular section which may be equal in length to one dimension (width) of the overlying table-top, and a pair of brackets secured to the underside of the table-top adjacent respective side edges thereof, each bracket having a circular opening in which each end of the tubular section is pivotally journaled, and means for preventing axial movement of the tubular section.

Means for pivotally connecting the table-top support member to each leg member comprises a lever arm having a circular opening adjacent one end thereof in which an end of the tubular section of the table-top support member is pivotally journaled, and means adjacent the other end of the lever arm securing one of the leg portions thereto, as by a threaded nut and bolt passed through the leg portion.

Adjustability of the height of the table-top is effected by forming each of the generally vertical leg portions of the main frame from a pair of telescoping tubular portions, providing a helical compression spring within the outer one of the pair of telescoping tubular portions, providing first abutment means adjacent the lower generally vertical portion of the outer one of the tubular portions against which the lower end of the spring bears, second abutment means adjacent the lower end of the inner one of the pair of tubular portions against which the upper end of the spring bears, and means for releasably clamping the inner and outer tubular portions in a selected telescoped relation, the spring tending to bias the inner tubular portion outwardly (i.e. upwardly when the table is in operative position) relative to the outer tubular portion.

It will be understood that the p air of telescoping tubular portions making up the leg portions of the main frame may be of circular or square cross-section. On the other hand, the elongated tubular section of the table-top support member is preferably circular in cross-section.

BRIEF DESCRIPTION OF THE DRAWINGS

Reference is made to the accompanying drawings wherein.

DESCRIPTION OF THE PREFERRED EMBODIMENTS

Figure 1:
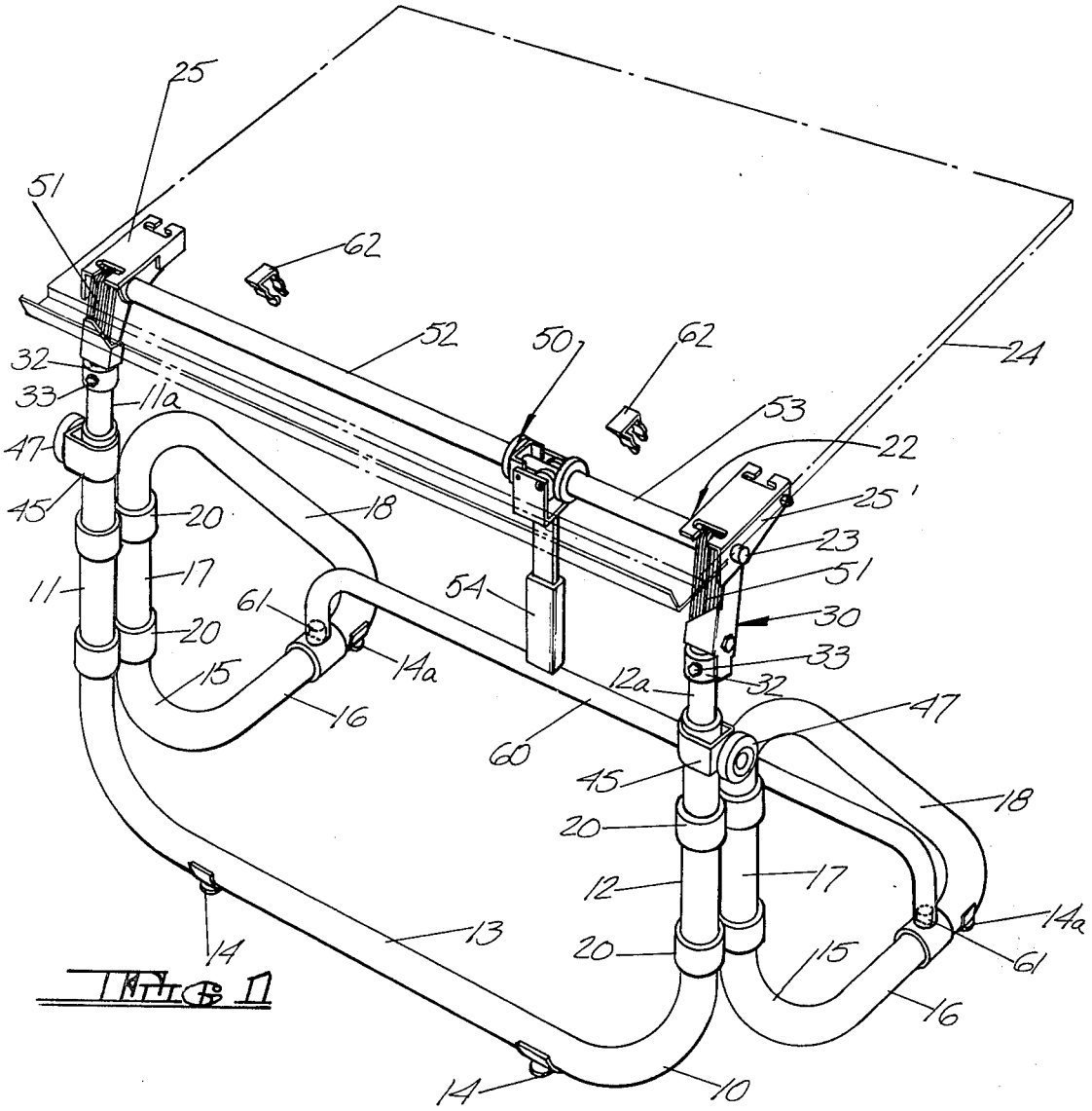
FIG. 1 is a perspective view of a drafting table embodying the invention in operative position.
Figure 2:
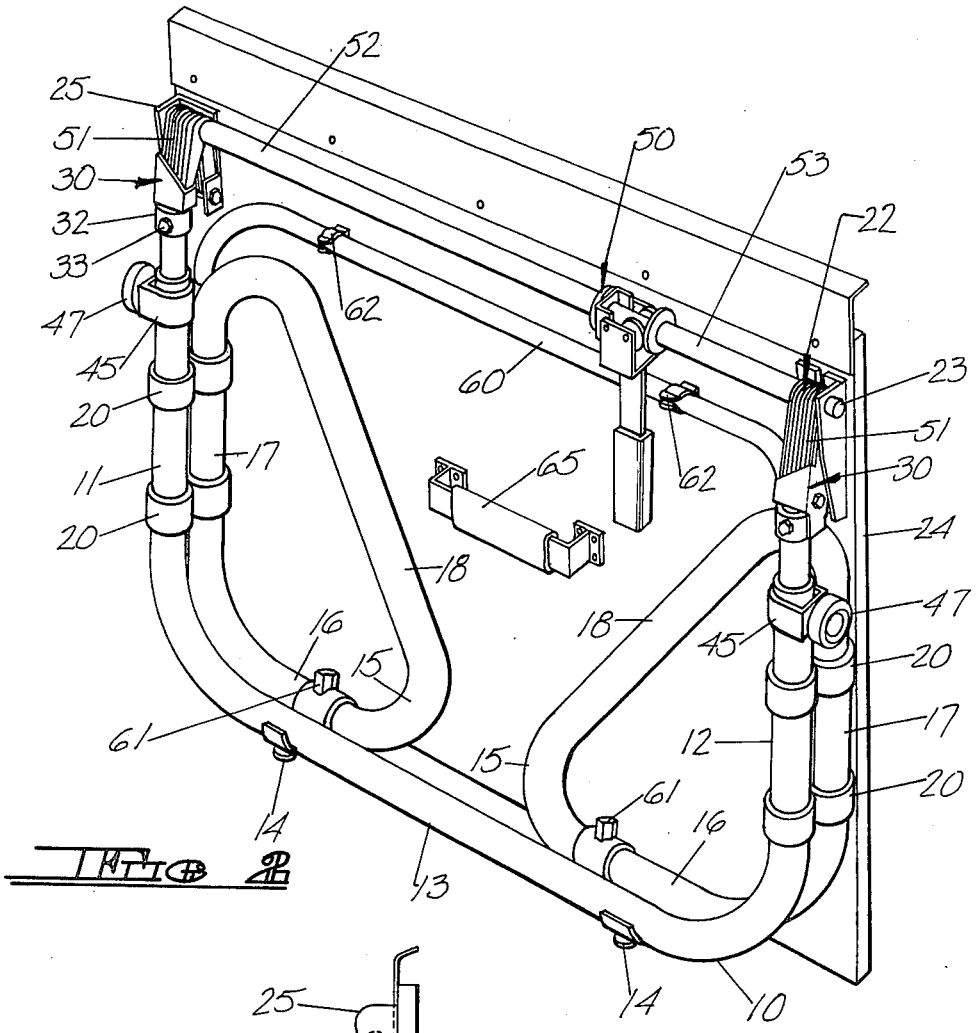
FIG. 2 is a perspective view of the table of FIG. 1 in folded position.

Referring to FIGS. 1 and 2 of the drawings, a U-shaped main frame is indicated at 10 comprising a pair of spaced, generally vertical leg portions 11 and 12 and a generally horizontal connecting portion 13 which may be provided with conventional leveling means 14.

A pair of side members is indicated at 15. Since the side members are identical, like reference numerals are used for each. Each side member comprises a lower arm portion 16 adapted to rest substantially horizontally on a floor substantially normal to the plane of the main frame 10 when the table is in operative position, a generally vertical upper arm portion 17, and an inclined connecting member 18, the side members thus having a generally triangular configuration.

Means are provided indicated at 20 for pivotally connecting the upper arm portion of each side member 16 to a respective one of the leg portions 11, 12. The means 20 may comprise two pieces of tubing welded together having an inside diameter substantially equal to the outside diameter of leg portions 11, 12 and upper arm portion 17. The tubular piece surrounding leg portions 11 and 12 is non-rotatably secured to each leg portion as by welding, whereas the upper arm member 17 is free to pivot in the other piece of tubing. To insure maximum stability and strength, it is preferred to provide two pivotal connecting means 20 on each leg portion 11 and 12 in spaced apart relation as shown in FIGS. 1 and 2.

In the illustrated embodiment of pivotal connecting means 20, it is necessary that the tubular members 11, 12 and 17 be circular in cross-section. However, it is within the scope of the invention to use tubular members having a square cross-section and to substitute hinges which would function in an equivalent manner.

Figure 3:
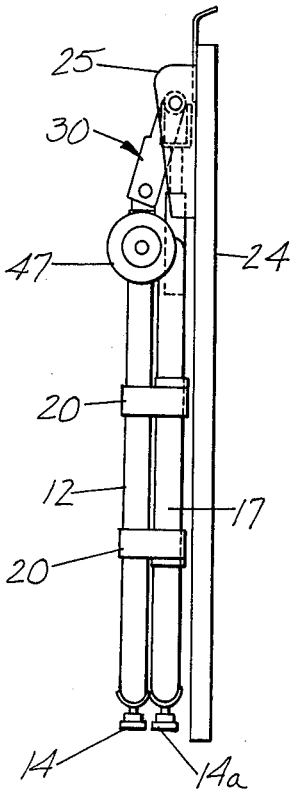
FIG. 3 is a side view of the folded table of FIG. 2.

Referring to FIG. 2, it will be noted that the length of each lower arm portion 16 is less than one-half the length of the connecting member 13 of main frame 10, so that each triangular side member 15 may be pivoted inwardly without overlapping so as to lie flat against the main frame substantially parallel thereto, and each side member thus lies in a common plane. The extremely compact package which results from the relative dimensions and configuration of the members 10 and 15 is best shown in FIG. 3.

Figure 4:
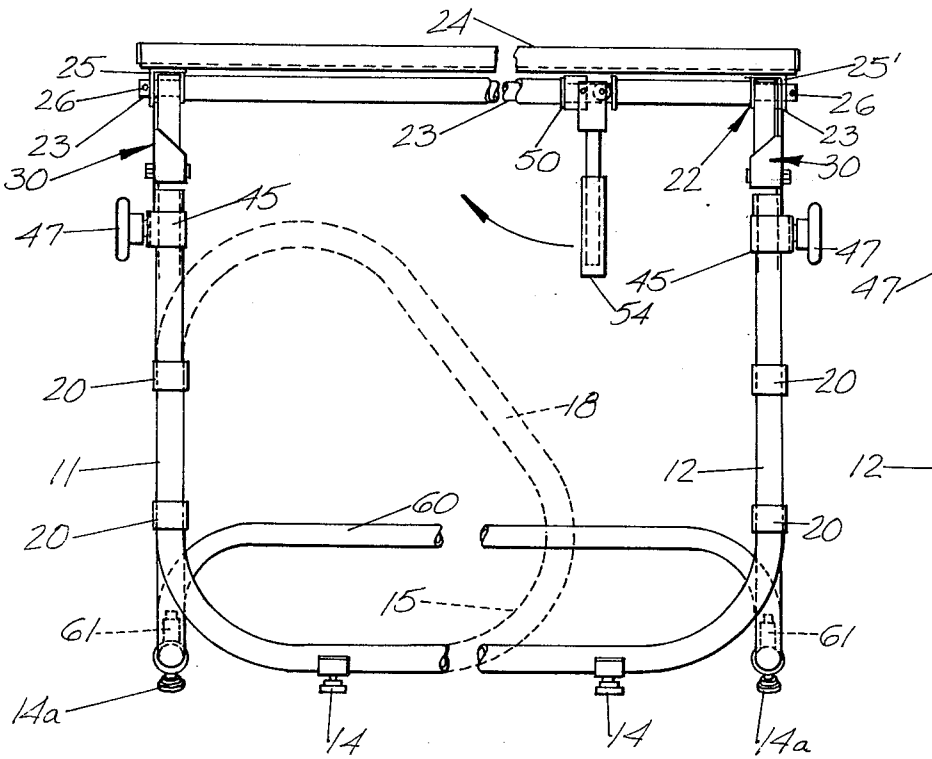
FIG. 4 is a front plan view of a table embodying the invention illustrating the amount of pivoting of a side member.

Referring to FIGS. 1, 2 and 4, a table-top support member is indicated generally at 22. This comprises an elongated tubular section 23 (FIG. 4) substantially equal in length to the width of a table-top indicated at 24, or in other terms slightly greater in length than the distance between the leg portions 11, 12. The support member further comprises a pair of brackets 25, 25' secured as by screws or the like to the underside of table-top 24 adjacent respective side edges thereof, and each bracket has a circular opening therein in which an end of tubular section 23 is pivotally or rotatably journaled. Means are provided at each end of tubular section 23, as indicated diagrammatically at 26 in FIG. 4 for preventing axial movement of tubular section 23. Means 26 may comprise a cotter pin or the like.

Figure 6:
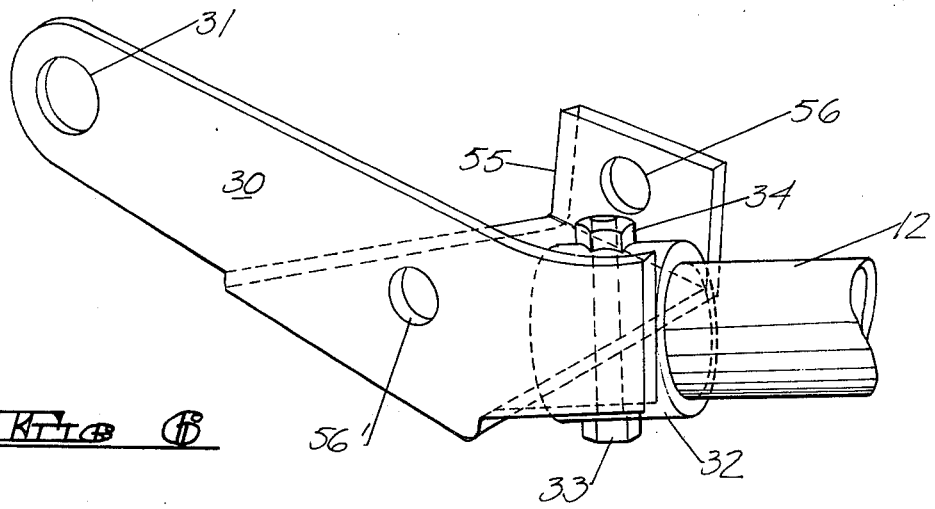
FIG. 6 is a perspective view, partially in section, of means for pivotally connecting the table-top support member to a leg member.

Means for pivotally connecting the table-top support member 22 to each of the leg portions 11 and 12 are indicated generally at 30. As best seen in FIG. 6, means 30 comprises a lever arm having a circular opening 31 adjacent one end thereof in which each end of tubular section 23 is pivotally journaled. At the other end of lever arm 30 means are provided for securing the lever arm to one of the leg portions 11, 12. By way of exemplary showing a sleeve 32 is provided fitting over the top of a leg portion 11 or 12, and a bore is formed passing through the sleeve and leg portion through which a threaded bolt 33 may be passed and secured by a nut 34. Other equivalent means of securing a lever arm to the leg portion 11 or 12 will be evident to those skilled in the art and are to be considered within the scope of the invention.

Figure 7:
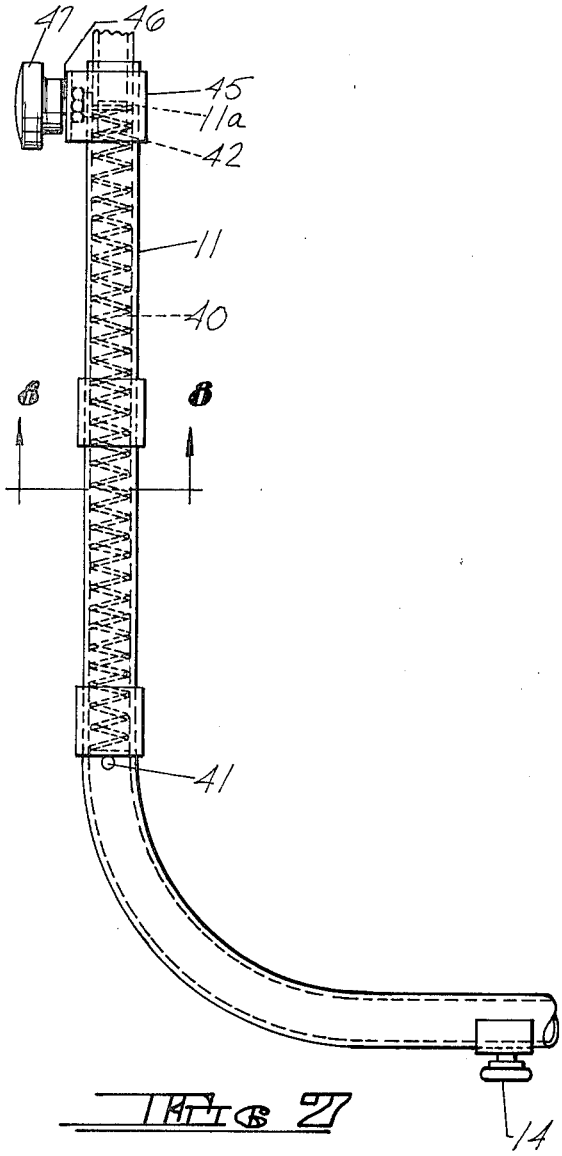
FIG. 7 is a vertical sectional view of a main frame of a table embodying the invention and means for adjusting the lengths of each leg portion.
Figure 8:
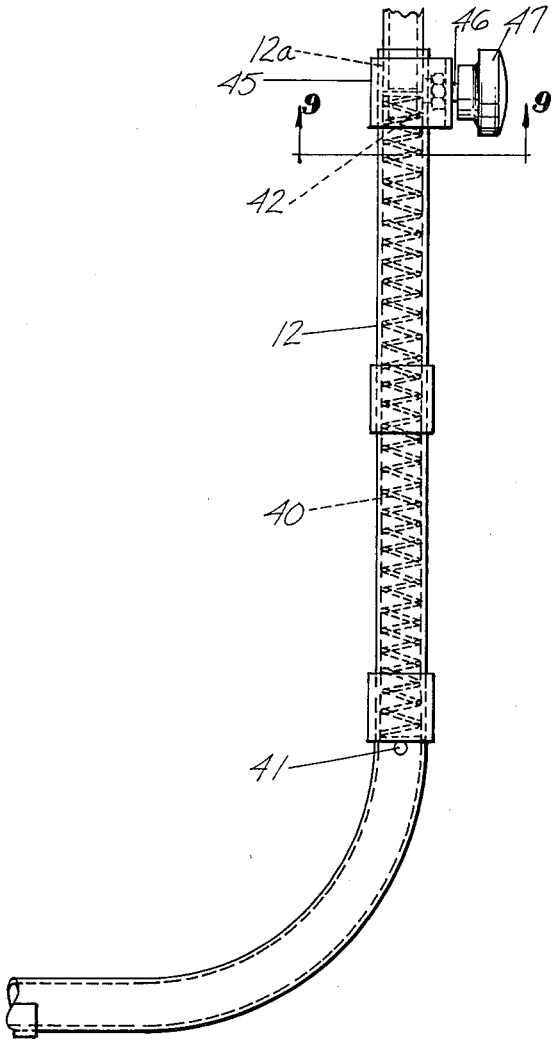
FIG. 8 is a sectional view on the line 6—6 of FIG. 7.
Figure 8:
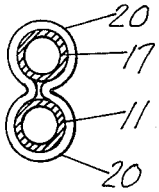

Means for adjusting the length of each of the leg portions 11, 12 and consequently the vertical height of the table-top 24 are shown in FIG. 7. Preferably, such means includes tubular portions 11*a*, 12*a* in coaxial telescopic relation to leg portions 11, 12, as shown in FIGS. 1, 2 and 7.

A helical compression spring indicated at 40 is provided within each of the tubular leg portions 11, 12. First abutment means indicated at 41 in FIG. 7 is provided in each of the tubular leg portions 11 and 12 adjacent the lower generally vertical portion thereof, against which the lower end of spring 40 bears. Second abutment means, indicated at 42 in FIG. 7 are provided adjacent the lower end of telescoping tubular members 11*a*, 12*a*. Such second adjustment means can comprise simply a cap or other end closure over the open end of tubular portions 11*a*, 12*a*. It will be evident that the provision of springs 40 in each of the generally vertical leg portions tends to bias telescoping tubular portions 11*a*, 12*a* outwardly relative to portions 11 and 12, or upwardly when the table is in operative position. Since the table-top and support member may have substantial weight, the compression springs substantially counterbalance this weight and make selective vertical adjustment of the height of the table-top substantially effortless. Moreover, height adjustment of the table-top over a relatively wide range of from about 30 to about 39 inches from the floor is possible. This accommodates seating either in a conventional chair, on a drafting stool, or standing at the table.

Figure 9:
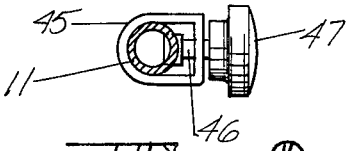
FIG. 9 is a sectional view on the line 9—9 of FIG. 7.

The height adjustment means further includes means for individually releasably clamping telescoping tubular sections 11, 11*a* and 12, 12*a* in any desired position of telescoped relation, such means comprising by way of exemplary showing a friction lock arrangement as illustrated in FIG. 9. This comprises a collar 45 secured as by welding around each of tubular leg portions 11 and 12 adjacent the upper end of each having a threaded opening mating with an opening in tubular portion 11 or 12 in which a threaded bolt 46 is engaged as shown in FIG. 9. The end of the bolt bears against telescoped tubular section 11*a* and 12*a* to provide a friction lock. For ease in turning bolt 46 an enlarged knob 47 is preferably provided.

Means are provided for securing table-top support member 22 in a desired position of pivotal adjustment independent of the above described means for adjusting the height of the table-top. It will of course be understood that pivotal adjustment of the table-top support member also adjusts the angle or tilt of the table-top since the latter is secured to the support member rigidly by means of brackets 25, 25'. The means for securing the table-top support member in a desired position of pivotal adjustment can be obtained as a separate unit from Hamilton Industries of Two Rivers, Wisconsin, and it forms no part of the present invention apart from the claimed combination of elements which constitute this invention. Consequently, the pivotal adjustment means will not be described in great detail although the essential components thereof are illustrated in the drawings and indicated generally at 50. By way of brief explanation, a plurality of interdigitated leaf spring members is provided adjacent each end of tube 23 as shown at 51, and these leaf spring members operate in the same manner as a disc brake. Two tube sections 52 and 53 are provided which are coaxial with tubular section 23 and which may be cammed from a released position to a compressed position by movement of lever arm 54, the direction of movement of arm 54 being shown in FIG. 4. The leaf springs 51 have elongated sections with aligned openings in each adjacent one end thereof. Alternate ones of the leaf springs project generally downwardly as shown in FIGS. 1 and 2, and lever arm 30 is provided with an angle member 55 having an opening 56. The arrangement is such that a bolt may be inserted through opening 56 and the aligned openings in leaf springs 51 and through another opening 56' in lever arm 30 so that alternate ones of leaf springs 51 move with lever arm 30. The remaining leaf springs are similarly secured adjacent their elongated ends to brackets 25, 25' so that they move with table-top 24.

Figure 5:
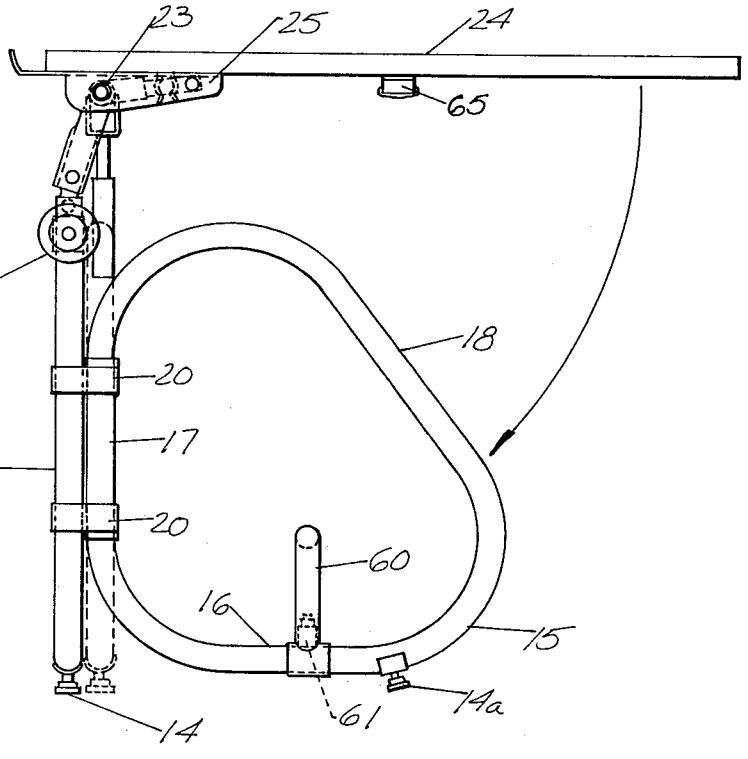
FIG. 5 is a side plan view illustrating the manner of adjusting the angle of the table-top.

The independent means for securing the table-top support member in a desired position of pivotal adjustment permits selection of the angle or attitude of the table-top 24 at any position ranging from horizontal to about 70° below horizontal where it would contact connecting member 18 of side members 15, as shown in FIG. 5. Thus a movement between about 90° (horizontal) to about 160° is possible.

To insure against accidental dislodgement of the side members 15 when the table is in operative position, it is preferred to provide a brace indicated at 60 which extends transversely between the lower arm portion 16, with means indicated at 61 for releasably engaging each end of brace 60 with one of the lower arm portions. This will hold the arm portions substantially normal to the plane of the main frame 10. In the illustrated embodiment, brace 60 is a tubular member in the form of an inverted U, and the down-turned open ends of each end of the tube engage upstanding nipples 61 secured to lower arm portions 16 in any conventional manner such as welding.

When the table is to be folded into collapsed position, the brace 60 is removed and attached to the underside of table-top 24 for releasable stowing by means of clip means 62, as shown in FIG. 2. It will be noted that clip means 62 are so located as to permit stowing the brace 60 with clearance between the inwardly folded side members 15 and the table-top support member 22. In the folded position, the table thus has no loose parts and is a compact, portable package. A carrying handle or the like may be provided, as indicated at 65 in FIG. 2.

The table-top 24 may be of any conventional type and fabricated of wood, wood or particle board laminated with metal or may be a so-called light table having a translucent upper surface with a light source provided thereunder for tracing. The dimensions and configuration of the table-top do not constitute a limitation, but by way of example, dimensions of 44 inches by 32 inches have been found to be a convenient size. The positioning of the table-top with respect to support member 22, while illustrated as being near one edge of the table-top, is also subject to variation, depending upon the desired balance of the table in operative position.

Modifications may be made without departing from the spirit and scope of the invention, and no limitations should be inferred except as set forth in the appended claims.

I claim:

1. A folding drafting table comprising a U-shaped main frame having a pair of spaced, generally vertical leg portions, each of said leg portions comprising a pair of telescoping tubular portions, a pair of side members each having a lower arm portion adapted to rest horizontally on a floor substantially normal to the plane of said main frame and a substantially vertical upper arm portion, each of said side members being generally triangular and of a dimension less than one-half the distance between said pair of spaced, generally vertical leg portions, means for pivotally connecting said upper arm portion of each said side member to a respective one of said leg portions whereby said side members may be folded inwardly flat against said main frame in a connon plane, a table-top support members extending substantially horizontally above the top of said leg portions means for pivotally connecting said table-top support member to each of said leg portions comprising a lever arm having a circular opening adjacent one end thereof in which an end of said tubular section is pivotally journaled, and means adjacent the other end of said lever arm securing one of said leg portions thereto, means for adjustingthe length of each of said leg portions comprising a helical compression spring within the outer one of said pair of telescoping tubular portions, first abutment means adjacent the lower generally vertical portion of said outer one of said tubular portions against which the lower end of said spring bears, second abutment means adjacent the lower end of the inner one of said pair of tubular portions against which the upper end of said spring bears, and means for releasably clamping said inner and outer tubular portions in a desired telescoped relation, said spring tending to bias said inner tubular portion outwardly relative to said tubular portion, said adjusting means biasing said table-top support member upwardly, means for securing said table-top support member in the desired position of pivotal adjustment independent of said means for adjusting the length of each said leg portion to secure said table-top at any desired angle between horizontal and about 70° below horizontal without adjustment of the lengths of said leg portions, means for securing said lever arm to said means for securing said table-top support member in a desired position of pivotal adjustment for movement therewith, and a table-top secured in overlying relation to said table-top support member for swinging movement between horizontal and folded positions, said table-top support member comprising an elongated tubular section substantially equal in length to one of the length and width dimensions of said overlying table-top, and a pair of brackets secured to the underside of said table-top adjacent respective side edges thereof, each bracket having a circular opening therein in which each end of said tubular section is pivotally journaled, and means for preventing axial movement of said tubular section, said table-top in folded position being substantially parallel to said main frame with said side members interposed therebetween.

2. The table claimed in claim 1 including a brace extending between said lower arm portions when substantially normal to said plane of said main frame, and means for releasably engaging each end of said brace with one of said lower arm portions.

3. The table claimed in claim 2, including clip means attached to the underside of said table-top for releasably stowing said brace when said table-top is swung into said folded position, said clip means being so located as to stow said brace with clearance between said inwardly folded side members and said table-top support member.

* * * * *